US005430461A

United States Patent [19]

Tsai

[11] Patent Number: 5,430,461

[45] Date of Patent: Jul. 4, 1995

[54] TRANSISTOR ARRAY FOR ADRESSING DISPLAY PANEL

[75] Inventor: Chun-hui Tsai, Hsinchu, Taiwan

[73] Assignee: Industrial Technology Research Institute, Hsinchu, Taiwan

[21] Appl. No.: 112,124

[22] Filed: Aug. 26, 1993

[51] Int. Cl.[6] ..... G09G 3/36

[52] U.S. Cl. ..... 345/100; 345/94; 345/98

[58] Field of Search ..... 345/213, 94, 95, 100, 345/98; 359/55, 54

[56] References Cited

U.S. PATENT DOCUMENTS 4,317,115 2/1982 Kawakami et al. ..... 359/55
5,111,195 5/1992 Fukuoka et al. ..... 345/94
5,153,483 10/1992 Kishino et al. .

*Primary Examiner*—Richard Hjerpe
*Assistant Examiner*—Vivian Chang
*Attorney, Agent, or Firm*—George O. Saile; William S. Robertson

[57] ABSTRACT

A flat panel display has an improved selection circuit for scanning row lines while data signals are applied to column lines for writing a selected image onto the pixel forming elements along the selected row line. The number of row lines, N, is chosen to be the product of two numbers, P and Q and preferably N is a perfect square. A first timing circuit provides Q number of non-overlapping timing signals that each have P narrow clock pulses each of a width for writing data into one row the display; it also provides P number of non-overlapping timing signals that each have clock pulses with a width of Q write operations. For each row line of the display, the selection circuit has an AND logic circuit that responds to one wide pulse clock line and one narrow pulse clock line to connect the row line to a voltage to enable the pixel forming elements to turn on in a write operation. Another logic circuit for each row line selectively connects the line to a voltage to inhibit the turn on of the pixel forming elements. This circuit has a single gate that responds to the complement of the associated narrow pulse clock signal, and this gate closes to isolate a selected line from the inhibiting voltage. The gate is open for only a minimum time so that an unselected line with this gate open can not float electrically to a voltage that could allow its pixel elements to turn on.

11 Claims, 2 Drawing Sheets

TRANSISTOR ARRAY FOR ADRESSING DISPLAY PANEL

FIELD OF THE INVENTION

This invention relates to display panels and more specifically to an improved addressing circuit for a display panel of the type that has a transistor for each pixel position on the screen.

INTRODUCTION

Some display panels have an array of points called pixels where light is selectively emitted or otherwise affected to form an image. In some displays, each pixel forming element is connected to be controlled by signals on data lines and selection lines. The data lines run along the columns of the array and the selection lines run along the rows. Ordinarily the arrau of pixels are similarly arranged in rows and columns on the display panel. When a suitable voltage is applied to a row line and a column line, the pixel element at their intersection is turned on. In some of these displays, each pixel has a transistor that is turned on or off by the voltage on the associated row line and column line.

Ordinarily, the row and column signals are applied in a scanning sequence. The row lines are energized one at a time in sequence. During the time interval for applying the voltage to one row line, a binary valued voltage is applied to each column line according to whether the pixel in the selected row and the particular column is to be on or not on.

In displays of the type that have a transistor at each row and column intersection, a transistor is enabled to be turned on by the row selection line and is turned on or left off by the voltage on the column line. While the transistor is turned on, the capacitance of the pixel element is charged, and this charge keeps the pixel on for a selected portion of the time for scanning all of the row lines.

SUMMARY OF THE INVENTION

One object of this invention is to provide an improved row selection circuit that reduces the number of connections between these lines and other components of the display.

The number of row lines is called N and is preferably a perfect square. Thus, there are N write times in a scanning sequence. The clock circuit produces two sets of clock pulses and each set is produced on N clock lines. In the example that will be used later, a display with 16 row lines is operated with 8 clock lines. In one set, the clock pulses are narrow and are of a width for writing one row of the display. They occur multiple times on each of their clock lines during a scanning sequence and together they fill the entire scanning sequence. In the other set, the pulses are wide and occur only once on their clock line in each scanning sequence; they are non-overlapping and together they fill the full scan time. Each write time is defined uniquely by the coincidence of one wide clock pulse and one narrow clock pulse, and each row line of the display has logic gates that select the line at the appropriate time in the scanning sequence.

Another object of this invention is to avoid the resistors that have been used in display selection circuits.

Each row line of the display has a connection to ground that prevents the line from floating electrically and possibly acquiring a voltage that could cause its pixel forming elements to be turned on while the line is unselected. This circuit is simplified by providing a single gate in each line between a row line and ground. The gates are controlled by the complement of the narrow clock timing signals in a pattern that isolates the selected row line from ground but connects most of the other row lines to ground. An unselected line floats while the corresponding narrow clock pulse is applied to the selected row line, but this time will ordinarily be short enough to prevent the line from acquiring an undesirable voltage level.

The selection circuit will be particularly useful for a thin film transistor (TFT) display panel. Other applications for the invention and additional objects and features of the invention will be apparent from the description of the preferred embodiment.

THE DRAWING

THE PREFERRED EMBODIMENT

Conventional Components of the Display

Figure 1:
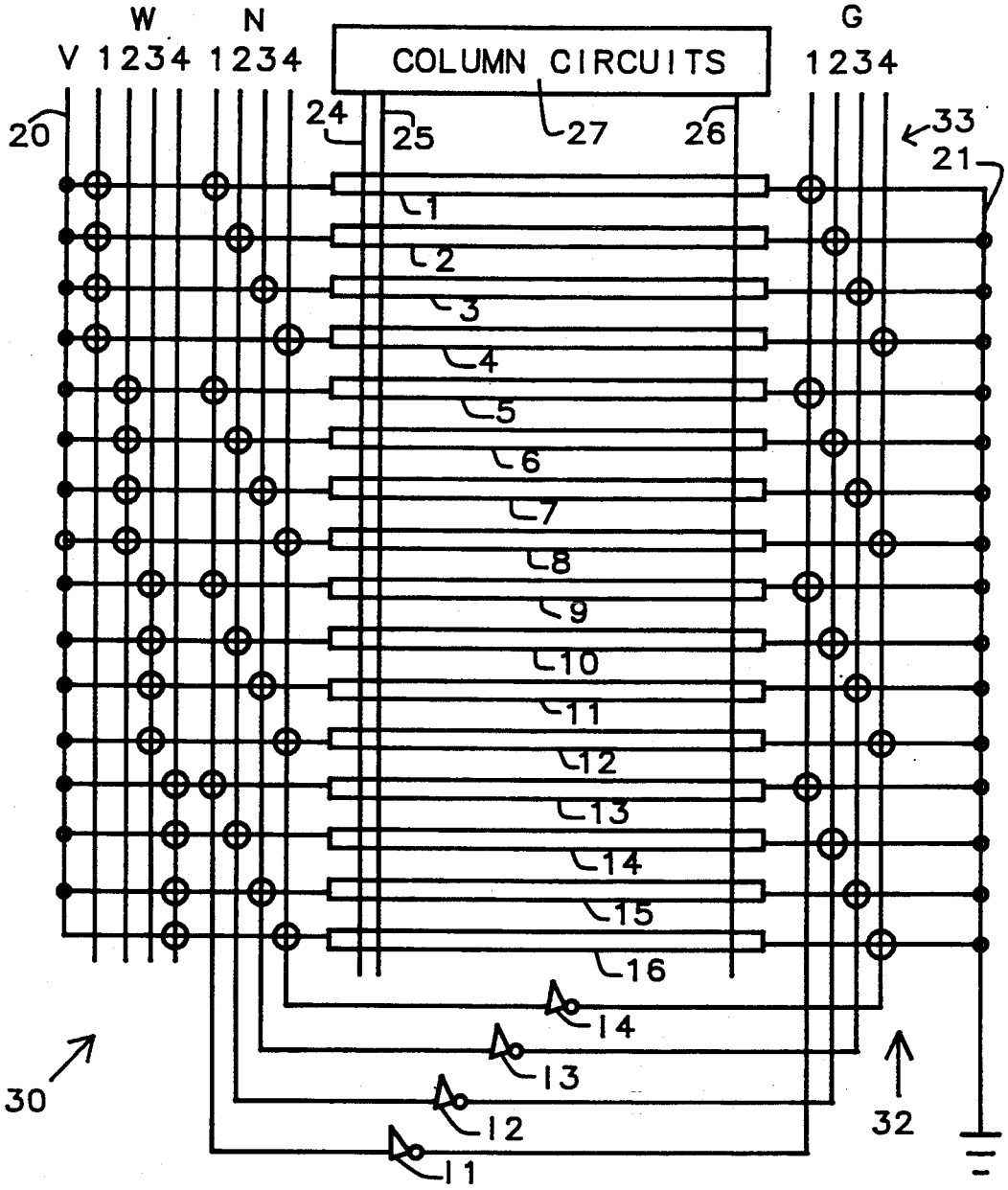
FIG. 1 is a schematic drawing of a display panel and the selection circuit of the preferred embodiment of this invention.

Displays are well known and the conventional features are shown in a simplified form. A vertical line 20 to the left of FIG. 1 is connected to a suitable voltage source, V, and a vertical line 21 to the right is connected to ground. The row lines of the display are shown as thin horizontal bars to distinguish them from other conductive lines in the drawing. A scanning circuit that will be described later connects each row line in sequence to the voltage source V.

The display of FIG. 1 has 16 lines and they are numbered 1 to 16 to represent their scanning sequence. This sequence will be referred to later in the description of the operation of the display, and it arbitrarily starts at the top row line and ends at the bottom row line. The small display with 16 row lines shown in FIG. 1 illustrates a preferred display with 1024 row lines, as will be discussed later.

The time for scanning one row line will be called a write time and the time for scanning all of the lines will be called a scanning sequence time. Representative column lines 24, 25 and 26 are connected to a circuit 27 that produces column signals according to the image that is to be displayed along the selected row line.

The circuit 27 receives data signals for each column line for each write time, and it receives appropriate clock signals for the write operations. These components and connections are conventional and are not shown in the drawing.

The Preferred Pixel Forming Elements

The preferred display has a transistor at the intersection of each row and column line. Preferably, a thin film transistor (TFT) is formed on the glass or polymer of the display structure, as is well known. One terminal of the transistor is connected to the column line and one terminal is connected to the row line so that the transistor conducts at its other terminal when it is turned on. When a row line is not selected, it is given a voltage that prevents the transistors along the row from turning on in response to a signal on the column line. The transistor is turned on only for the relatively short portion of the scan time when its row line is selected. During this time, the transistor charges the capacitance of the pixel forming element and capacitance discharges at an appropriate rate to maintain the display image without flicker.

Various light affecting devices can be controlled by a transistor, and the invention is useful with various display technologies.

Figure 2:
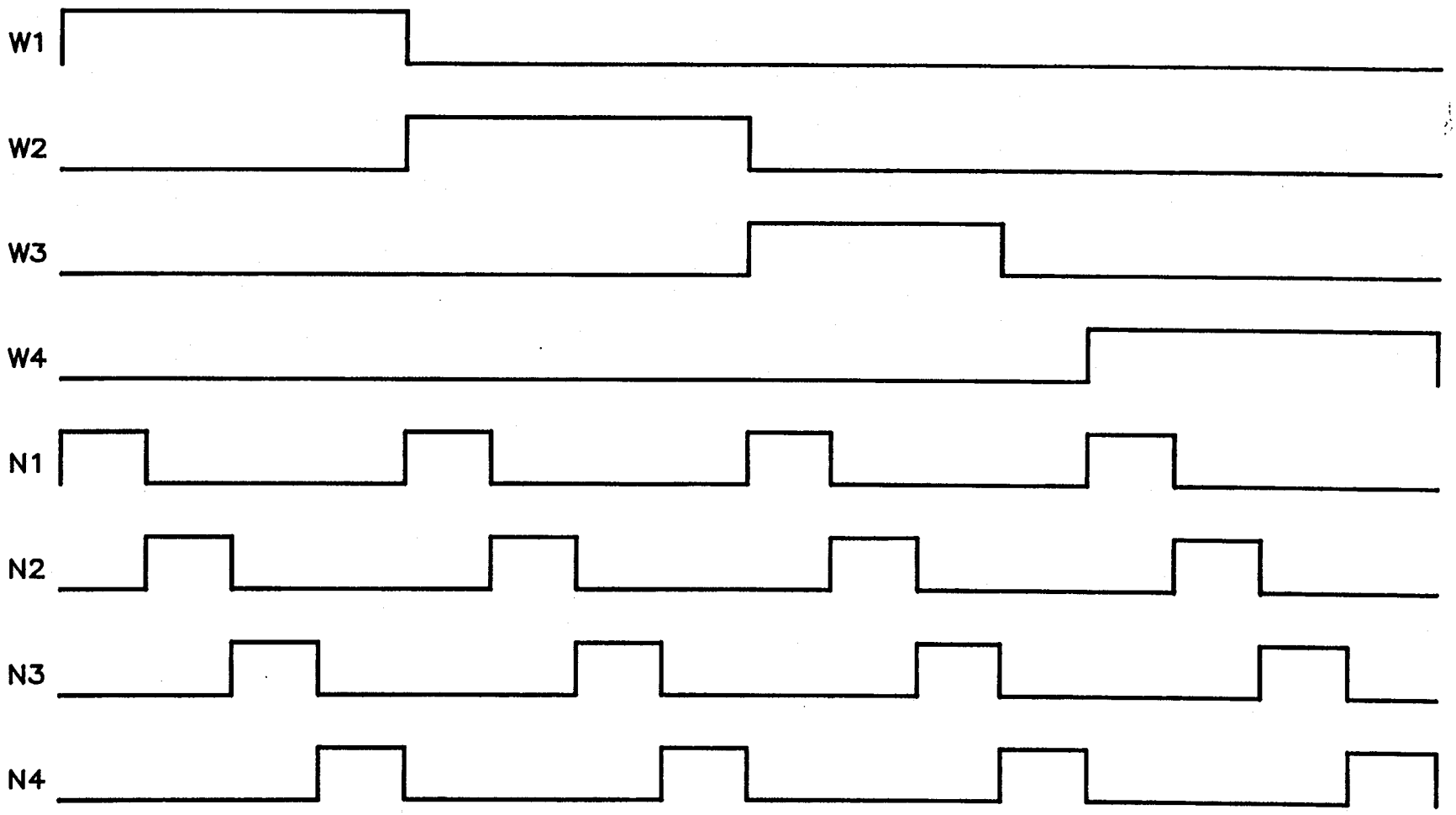
FIG. 2 is a timing diagram of the clock circuit of the preferred embodiment.

The Clock Signals for Row Selection—FIG. 2

It should simplify this description to start with an explanation of the clock signals. The display of FIG. 1 has 16 row lines and each of the 8 clock lines in FIG. 2 represents a full scan with 16 write operations, one for each row line.

Note that some of the lines in the timing diagram of FIG. 2 have wide pulses and some have narrow pulses. The narrow pulses represent the time for one write operation and each of these is one sixteenth of the time of the entire scan cycle. It will be convenient to describe the wide pulses and narrow pulses separately and to use the letters W and N (wide and narrow) to distinguish the signals and the related components. Thus, the four wide pulses in the upper part of FIG. 2 are designated W1 to W4 and the four narrow pulses in the lower part of FIG. 2 are designated N1 to N4.

Note that none of the wide pulses overlap and none of the narrow pulses overlap and that the wide pulses fill a scanning sequence time and that the narrow pulses fill a scanning sequence time. At any write time, one wide pulse and one narrow pulse overlap. As will be explained, a logic circuit responds to this coincidence for selecting a particular row line.

The selection circuit of this invention has 8 clock lines. The number of clock lines be understood by thinking of the 16 addresses for the row lines as being arrayed in a square that is 4 by 4. In effect, the clock provides a row selection pulse and a column selection pulse, and the selection circuit decodes these 8 lines and selects the corresponding one of the 16 lines.

The general operation of scanning this conceptual array is that each of the rows is selected in sequence for one fourth of the scanning sequence time. As FIG. 2 shows the first clock pulse rises at the beginning of the scanning sequence time and falls at the one quarter point. Similarly, the second timing line rises at the first quarter point and falls at the second quarter point. From a more general standpoint, the width of these timing pulses is the time for scanning the columns of the conceptual array and it is preferably N. While the first row of this conceptual array is scanned (and one of the wide pulses is up), the 4 columns of the conceptual array are scanned. Each of these columns is scanned for only one write time.

Implementing the Clock Timing Circuit

Clock timing circuits are commonly used in displays and many other information handling devices, and a specific description is unnecessary. Generally, these circuits have an oscillator that generates a square wave of a suitable starting frequency. Latches divide the starting frequency to form the wider pulses, and logic circuits select particular combinations of these pulses and their complements to created pulses that rise and fall at particular times.

The Row Selection Circuits—FIG. 1

A logic circuit 30 connects each row line to V in response to the coincidence of one clock signal from the wide group and one clock signal from the narrow group. As has already been explained, this combination is unique for each row line. The logic circuit is formed as an array of row lines and column lines, located to the left of the display area. Extensions of the row lines 1–16 form the horizontal lines of the logic array. Clock lines for the wide clock signals form one set of columns and have the reference characters of the corresponding clock signals in FIG. 2. Similarly, clock lines for the narrow clock signals form a second set of columns.

The logic gates are conventional semiconductor devices and are represented by circles. Each gate is formed by a semiconductor device such as an FET that has its drain and source terminals connected to conduct in the horizontal line of the selection logic array and its gate connected to receive the clock signal on the associated vertical line. When the clock signal is down, the FET turns off and isolates the row line from V; when the clock signal is up, the FET turns on and enables the connection between the row line and V.

When a clock pulse appears on a vertical line, any gates in the line are opened to transmit signals from the V to the associated row line. The series connection of two switches for each row line forms an AND logic circuit. In equivalent terminology, when the clock signal is up, the gate is open and enables the connection and when the clock signal is down the gate is closed and the row line from is isolated from V and is unselected. 19 Each horizontal line has two gates, one controlled by the one of the wide clock pulses and one controlled by one of the narrow clock pulses. Thus a line is connected to V on the coincidence of two clock pulses that are unique for the line. The logic circuit 30 can be formed as an array with row and column lines as FIG. 1 shows or the gates and their interconnections can be given a different physical arrangement.

The Grounding Circuit—FIG. 1

The non-selected row lines must be held at ground (or more generally, they must be held at a voltage that prevents the pixels in nonselected rows from being turned on.) A logic circuit 32 forms this selective connection between the row lines and ground. The logic circuit is formed by an array of gates that is similar to the selection gates and will be understood easily.

Extensions of the row lines are connected to ground through gates (represented by circles) in a way that is similar to the horizontal lines of the selection array. The gates are controlled by signals on the vertical lines in the selection circuit. A set 33 of four vertical lines G1 to G4 is arranged on the right side of the display in FIG. 1. These lines are connected to receive the complement of the narrow clock pulses (as will be explained) and the numeral suffixes 1 to 4 of the reference characters correspond to the numeral suffixes of the narrow clock signals.

Each extension of a row line has one gate, and the associated row line is connected to ground when its gate is closed. In the simplified circuit of this invention, each nonselected circuit is connected to ground most of the time, but it is allowed to float only for short intervals that are not sufficient for the capacitors to become charged by voltages in the selection circuits.

Four inverters I1 to I4, one for each narrow clock pulse line, form the complement of the corresponding clock signal. The output of each inverter is connected to the corresponding vertical line G1 to G4. Preferably, as FIG. 1 shows, the inverters are connected to receive the clock signals at the vertical lines N1 to N4 in the selection circuit (as contrasted with a direct connection to the timing circuit, which is some displays would require additional connections).

Suppose that the wide clock pulse W1 and the narrow clock pulse N1 are both up so that row line 1 is selected. In response to the up level on timing line N1, line G1 receives a down level signal and the gate for row 1 remains closed and isolates line 1 from ground while the selection gates in columns W1 and N1 for line 1 are opened to connect line 1 to V.

In response to the down levels on lines N2, N3 and N4, inverters I2, I3 and I4 produce up levels that open the gates associated with clock lines G2, G3 and G4. While an unselected row line is not grounded it is electrically floating and it can pick up a charge from nearby sources of voltage. If a row line were allowed to float long enough it could acquire the same voltage as a selected line and its transistors could turn on undesirably.

One effect of controlling these gates from the narrow pulses (as contrasted with the wide pulses) is that a row line is allowed to float only for the shortest interval of the clock circuit. Another effect is that the row lines that are near the selected line are grounded and are thereby protected from the voltage on a selected row line.

A Display with 1024 Row Lines

The preferred display has 1024 row lines, a number that provides a suitable display and is also a perfect square. The conceptual addressing array is 32 rows by 32 columns ( 1024=32). Accordingly, the circuit uses 64 clocks, 32 narrow clocks and 32 wide clocks.

OTHER EMBODIMENTS

The selection circuit of thins invention can be adapted to a number of row lines that is not a perfect square. A display with 32 row lines would be addressed with 12 timing pulses, as can be understood by considering a conceptual array of addresses that has 4 rows and 8 columns (or visa versa). Note that the product of the number of rows and the number of columns in the conceptual array (4 times 8) equals 32 the number of row lines and that the sum of these numbers (4+8=12) is smaller than the sum of any other product (such as 2 and 16).

Those skilled in the art will recognize other modifications of the preferred embodiment within the spirit of the invention and the intended scope of the claims.

I claim:

1. A display of the type having a two dimensional array of pixel forming elements, row lines and column lines intersecting at positions that correspond to the pixel positions, the number of row lines being denoted by N, where N is the product of two integers denoted by P and Q, a clock circuit defining a scanning sequence of clock signals, each scanning sequence having N write time intervals, one for each row of the display, means responsive to the clock signals for selecting the row lines one at a time for enabling a write operation in the pixel forming elements along the selected row, and means for energizing the column lines during each write time according to the part of an image to be formed along the scanned row line, wherein an improved row selection and clock circuit, comprises, means in the clock circuit providing P clock signals having wide clock pulses and Q clock signals having narrow clock pulses in a repeating pattern, the wide clock pulses being equal in width, being mutually non-overlapping, and spanning the full scan cycle time, the narrow clock pulses having a width corresponding to the time for writing one row of pixel elements, being mutually nonoverlapping, and spanning the full scan cycle time, whereby each write time is uniquely defined by the combination of one wide clock pulse and one narrow clock pulse, a logic circuit having logic gates for each row line connected in series to form an AND logic function and responsive to the coincidence of a wide clock pulse and a narrow clock pulse for applying a selection voltage to the selected row line for enabling the pixel elements along the selected row to turn on, and a single gate for each row line connected between the row line and a voltage for inhibiting the pixel forming elements along an unselected row when the inhibiting gate for an unselected row line is opened, means for connecting each said inhibiting gate to close in response to the complement of the narrow pulse received by the corresponding enabling gate in the logic circuit for causing each said inhibiting gate to switch oppositely to an enabling gate for the same row, whereby a simplified select ion circuit is provided.

2. The display of claim 1 wherein the row and column lines overlie the pixel positions.

3. The display of claim 2 wherein each pixel element includes a transistor connected to be responsive to the associated row and column lines.

4. The display of claim 3 wherein the transistor is a thin film transistor formed on the display.

5. The display of claim 1 wherein N is a perfect square and P=Q and the number of clock signal lines is 2 times N.

6. The display of claim 1 wherein the means for controlling each gate comprises an inverter having its input connected to receive the narrow pulse clock signal for the corresponding gate in the selection array and having its output connected to control the gate.

7. The display of claim 6 wherein the inhibiting gate and the connecting means comprises an array of lines arbitrarily called vertical lines and horizontal lines, the horizontal lines being extensions of the display row lines, each vertical line being connected to the output of a corresponding inverter, the single gate for each row line being connected in the horizontal line and connected to be controlled by a signal on the associated vertical line.

8. The display of claim 7 wherein the logic circuit for selecting a row line comprises an array of lines arbitrarily called vertical lines and horizontal lines, the horizontal lines being extensions of the display row lines, the vertical lines being connected to receive a clock signal, two logic gates in each horizontal line arranged to select the line in response to one wide clock pulse and one narrow clock pulse.

9. The display of claim 8 wherein the inputs of the inverters are connected to the vertical lines of the selection circuit array.

10. The display of claim 6 wherein an unselected line floats only for the interval of a narrow pulse.

11. The display of claim 10 wherein successive narrow pulses are applied to physically successive lines in the array, whereby the lines adjacent to a selected line are connected to the inhibiting voltage and only lines physically remote from the selected line are allowed to float, whereby capacitance of the lines does not become charged by voltages in the selection circuit.

* * * * *